US010272560B2

(12) United States Patent
Monahan et al.

(10) Patent No.: US 10,272,560 B2
(45) Date of Patent: Apr. 30, 2019

(54) MULTI-COMPONENT QUICK ASSEMBLY HANDLE AND METHOD OF MAKING SAME

(71) Applicants: Patrick H. Monahan, Arcola, IL (US); Kurt Ni, Taipei (TW)

(72) Inventors: Patrick H. Monahan, Arcola, IL (US); Kurt Ni, Taipei (TW)

(73) Assignee: Monahan Partners, Inc., Arcola, IL (US)

( * ) Notice: Subject to any disclaimer, the term of this patent is extended or adjusted under 35 U.S.C. 154(b) by 0 days.

(21) Appl. No.: 16/107,523

(22) Filed: Aug. 21, 2018

(65) Prior Publication Data

US 2018/0354119 A1 Dec. 13, 2018

Related U.S. Application Data

(62) Division of application No. 14/961,200, filed on Dec. 7, 2015, now Pat. No. 10,052,753.

(51) Int. Cl.

| | |
|---|---|
| ***A46B 5/00*** | (2006.01) |
| ***A47L 13/20*** | (2006.01) |
| ***B25G 1/04*** | (2006.01) |
| ***B25G 1/10*** | (2006.01) |
| ***B21D 41/00*** | (2006.01) |
| ***B25G 3/36*** | (2006.01) |
| ***A47L 13/42*** | (2006.01) |

(52) U.S. Cl.

CPC ..... *B25G 3/36* (2013.01); *A46B 5/002* (2013.01); *A47L 13/20* (2013.01); *A47L 13/42* (2013.01); *B21D 41/00* (2013.01); *B25G 1/04* (2013.01); *B25G 1/10* (2013.01)

(58) Field of Classification Search

CPC ..... A46B 5/002; A47L 13/20; B25G 1/10; B21D 39/048; B21D 41/00; B21D 41/04

See application file for complete search history.

(56) References Cited

U.S. PATENT DOCUMENTS

| | | | | |
|---|---|---|---|---|
| 2,313,474 | A * | 3/1943 | Hill | B01D 41/04 219/150 R |
| 3,601,838 | A | 8/1971 | Marx | |
| 2008/0216262 | A1 | 9/2008 | Kennedy | |
| 2013/0269131 | A1 | 10/2013 | Mallett | |
| 2014/0283361 | A1 * | 9/2014 | Van Essen | B21D 39/048 29/516 |

FOREIGN PATENT DOCUMENTS

| | | | |
|---|---|---|---|
| GB | 2 371 253 | * | 7/2002 |

* cited by examiner

*Primary Examiner* — Randall E Chin

(74) *Attorney, Agent, or Firm* — R. William Graham

(57) ABSTRACT

A multi-component quick assembly handle includes a first tubular member made of a permanently deformable material and having a first end permanently formed with a predetermined diameter (x) and connecting to a second end forming a remaining portion of said first tubular member of a smaller diameter (x−Δa), a second tubular member made of a permanently deformable material having a first end with a predetermined diameter (x) and connecting a second end having a larger diameter (x+Δb) and an inner diameter (y) to complementary receive by way of a friction fit said second end of said first tubular member. A method of forming multi-component quick assembly handle employs male and female tools to accomplish this.

10 Claims, 5 Drawing Sheets

MULTI-COMPONENT QUICK ASSEMBLY HANDLE AND METHOD OF MAKING SAME

This is a divisional of U.S. Ser. No. 14/961,200 filed Dec. 7, 2015, now U.S. Pat. No. 10,052,753, and claims the benefit therefrom.

BACKGROUND OF INVENTION

Field of the Invention

The instant invention relates to handles for handle held implements, such as broom and mops and other cleaning tools and long handled tools. More particularly, the invention relates to a multi-component quick assembly permanent handle and method of making same.

Related Art

There exist many elongated handles for use with mops, brooms and other hand held implements. Typically, these handles are generally cylindrical and have an end adapted with a connector such as a threaded end to be received in a complementary threaded female opening of the cleaning implement.

There also exist handles which thread together to extend the length the handles. These type of interconnecting handles tend to be relatively expensive and less fixably stable. The threaded components tend to want to loosen as they are used. Multiple threaded components increases this tendency to loosen.

There are also various forms of telescoping handles, where a smaller diameter tube fits inside a larger diameter tube, which limits the places an attachment can be added—such as a clip. The telescoping handles have a means for setting the handles at a certain length. These handles are more expensive and almost always become loose over extended use.

There are many expensive multi-piece handles which when assembled, are never disassembled. The purchaser has paid for a feature he doesn't need.

Accordingly, there remains a need to provide a more economical, quickly assembled and substantially fixable interconnected handle. The invention meets the desired need to improve interconnected handles.

SUMMARY OF THE INVENTION

It is an object to improve handles for hand held implements.

It is yet another object to improve multi-component quick assembly handle and method of making same.

It is still another object to improve a method of making multi-component quick assembly handle.

Yet another improvement is to provide a multi-component quick assembly handle which is postal friendly.

Yet another improvement is to provide a multi-component quick assembly handle which, once assembled, is close to being a permanent length handle.

Accordingly, the invention is directed to a multi-component quick assembly handle. The multi-component quick assembly handle includes a first tubular member made of a permanently deformable material having a first end permanently formed with a predetermined diameter and connecting to a second end forming a remaining portion of the first tubular member of a smaller diameter. There is also a second tubular member made of a permanently deformable material having a first end with a predetermined diameter substantially that of the first end of the first tubular member and connecting a second end forming a remaining portion of the second tubular member having a larger diameter and an inner diameter to complementary receive by way of a friction fit the second end of the first tubular member. At least one of the first ends having a connector for connecting a cleaning head, such as a mop or broom, to form a cleaning implement. Another embodiment employs intermediate tubular member(s) similarly formed for interconnection as described above.

A method of forming multi-component quick assembly handle, which includes the steps of providing a first tubular member and a second tubular member of a first predetermined inner diameter and a second predetermined outer diameter wherein the tubular members are made of a permanently deformable material, providing a female forming tool having a female forming end including a terminal portion of a smaller diameter than the first inner diameter and an inwardly extending section having a maximum outer diameter slightly larger than the first inner diameter, the section connecting to a remaining portion of the female forming tool and wherein the female forming end is inserted into an end of the second tubular member under pressure to permanently deform end of the second tubular member to be a female end.

Further, the method includes providing a male forming tool having a male forming end having an opening with an entry inner diameter larger than the second outer diameter of the tubular members and an inwardly disposed inner diameter approximately that of the maximum outer diameter of the female forming tool and wherein the male forming end receives under pressure an end of the first tubular member it permanently deforms an end of the first tubular member to have outer diameter deformed complementary to be friction fit received into the female end said second tubular member. The formed male end and female end are of a minimal tolerance to cause the same to become substantially permanently connected when press fit to each other. The method further includes providing a cleaning head, such as a mop or broom, providing a cleaning head connector and connecting the same to one of the first ends to form a cleaning implement.

The assembled invention replaces the previously described handles providing for multiple fixed length handles, filling the same functions and using the same storage space. The present invention can only be put together one way, thus making it a one-way assembly.

The invention is postal friendly. For example, United Parcel Services charges a $9 surcharge for packages over 60" on length. Many current cleaning tools are 60" or longer. The invention eliminates this charge by fitting the handle into a much smaller box, without loss of function.

DETAILED DESCRIPTION OF PREFERRED EMBODIMENT

Figure 1:
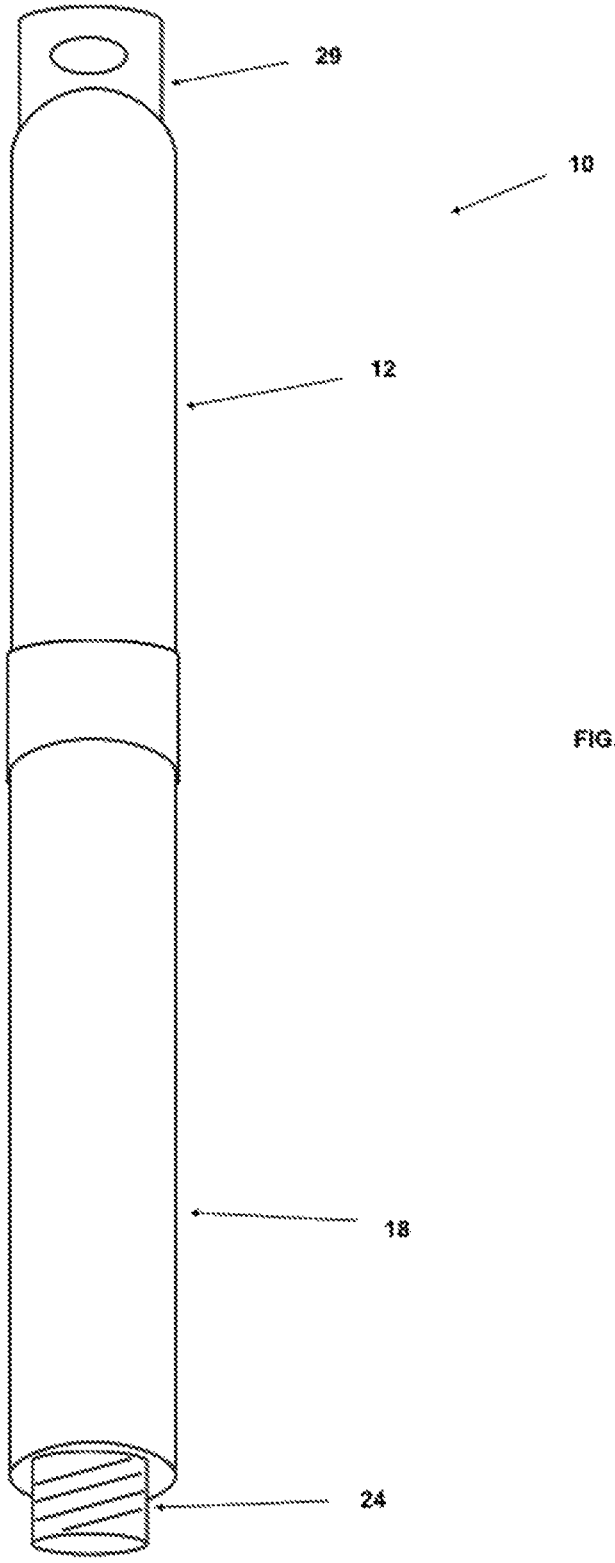
FIG. 1 shows the assembled components of the invention.
Figure 2:
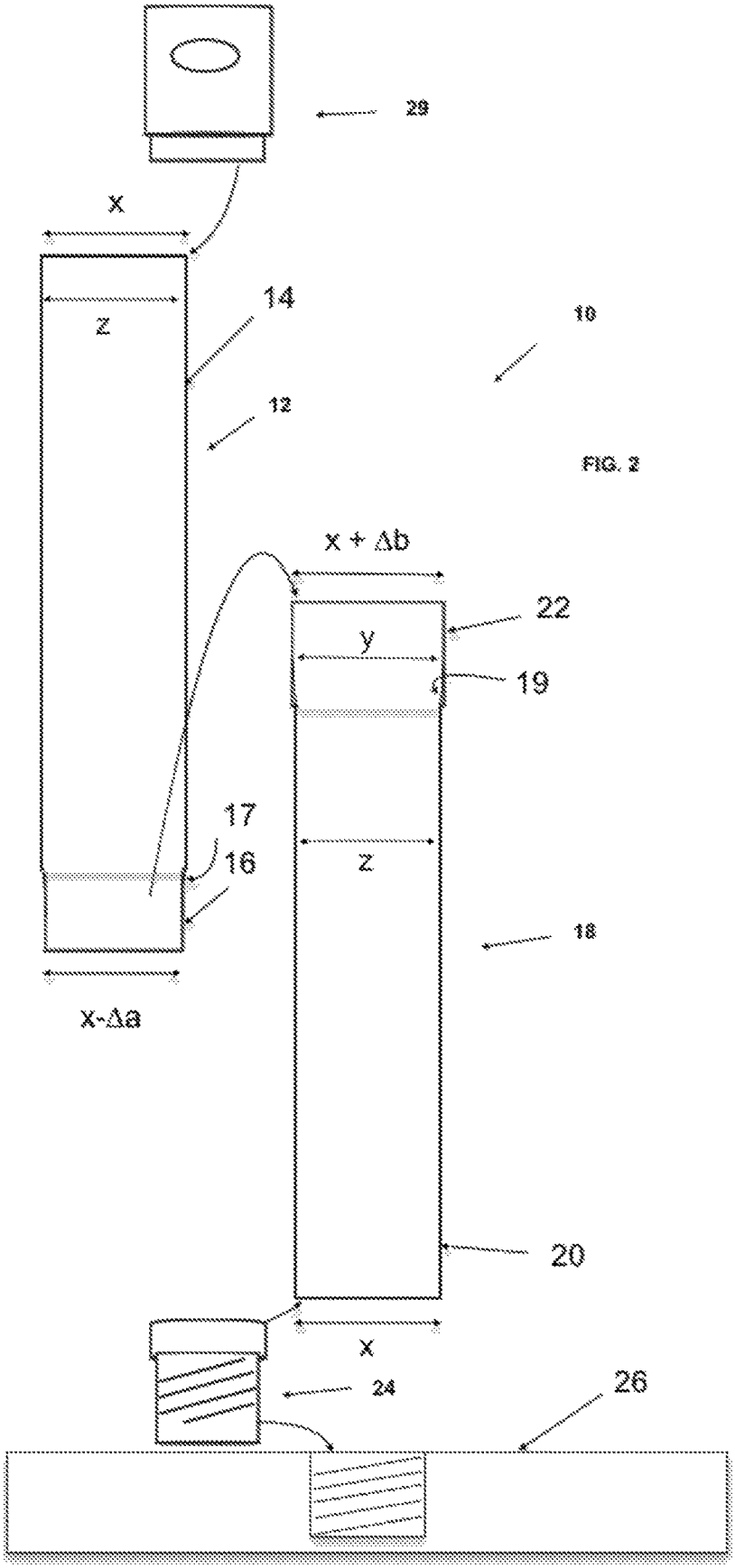
FIG. 2 is a side view drawing of components of the invention prior to formation.
Figure 3:
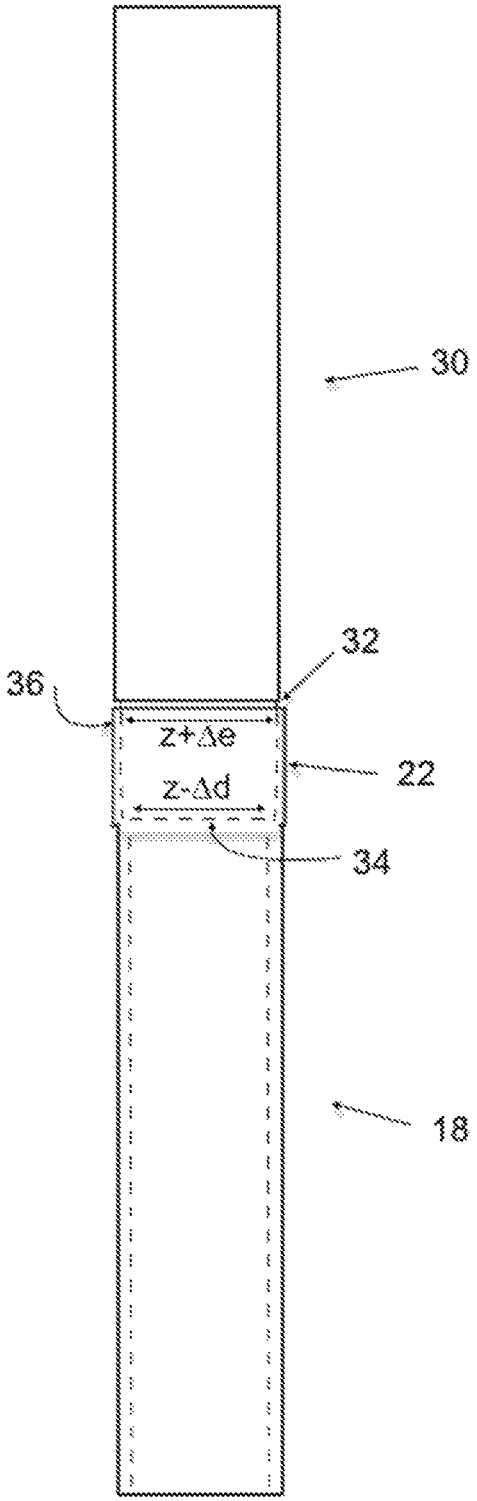
FIG. 3 shows a formation of a male component of the invention.
Figure 4:
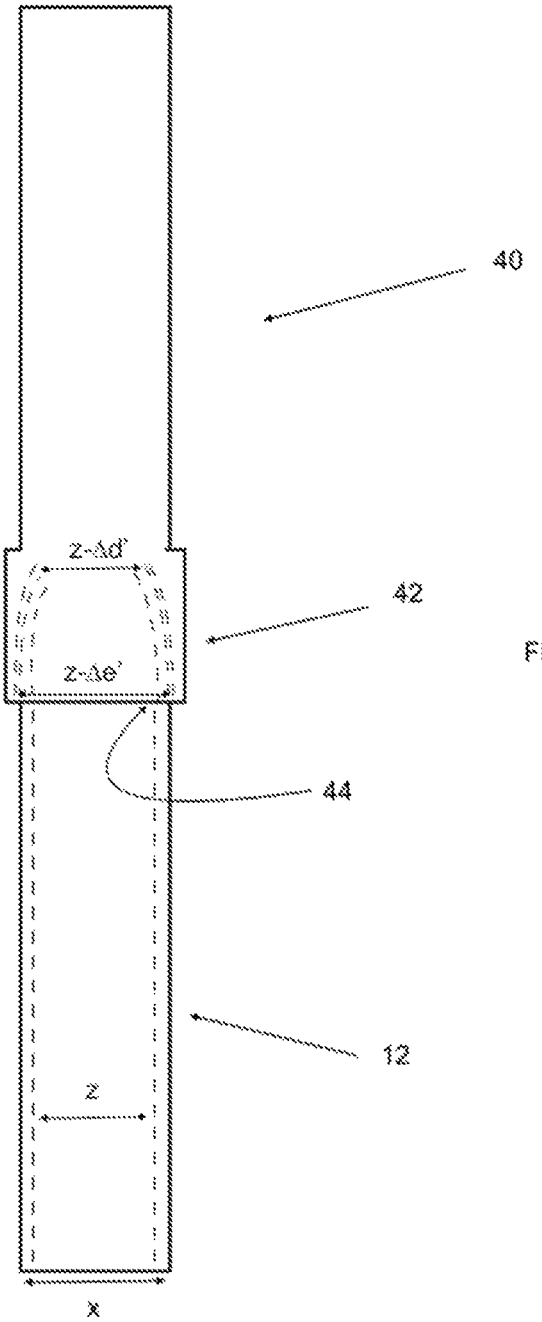
FIG. 4 shows a formation of a female component of the invention.

Referring now to the drawings, the multi-component quick assembly handle of the instant invention is generally designated by the numeral 10. The multi-component quick assembly handle includes a first tubular member 12 made of a permanently deformable material, such as aluminum or other extrudable metal material, for example. Bye "permanently deformable" it is understood that the material can be subjected to forces which cause it to take on a new permanent shape. The member 12 has a first end 14 formed with a predetermined diameter (x) and connecting to a second end 16 forming a remaining portion of the first tubular member 12 which is a smaller diameter (x−Δa) wherein the first end 14 connects to the second end 16 by way of a tapered section 17. There is also a second tubular member 18 made of a permanently deformable material preferably similar to that described above and having a first end 20 with a predetermined diameter (x) substantially that of the first end 14 of the first tubular member 12 and connecting a second end 22 forming a remaining portion of the second tubular member 18. The second end 22 has a larger diameter (x+Δb) and an inner diameter (y) slightly larger than diameter (x−Δa) which is to complementary receive by way of a friction fit the second end 16 of the first tubular member 12. The first end 20 connects to the second end 22 by way of a tapered section 19. At least one of the first ends, 14 or 20, e.g., 14 has a connector 24, e.g., which can be a press fit threaded connector, for connecting a cleaning head 26, such as a mop or broom, to form a cleaning implement. The connector 24 piece does not necessarily require a thread, for example, in the case of a broom the connector 24 can have an end wound directly thereto or a piece of mop hardware could be riveted on thereto. Additionally, there can be provided an end plug 29 with an eyelet for present into the bother end 20 or 14 for permitting hanging and storage of the cleaning implement.

A method of forming multi-component quick assembly handle 10 is also provided. The method includes the steps of providing a first tubular member 12 and a second tubular member 18 of a first predetermined inner diameter (z) and a second predetermined outer diameter (x) wherein the tubular members 12 and 18 are made of a permanently deformable material, such as that previously described. The method further provides a female forming tool 30 having a female forming end 32 including a terminal portion 34 of a diameter (z−Δd) smaller than the inner diameter (z) and a section 36 having a maximum outer diameter (z+Δe) slightly larger than the first inner diameter (z) which connects to a remaining portion 38 of the female forming tool 30 and wherein the female forming end 32 is inserted into end 22 of the second tubular member 18 under pressure to permanently deform into female end 22 of the second tubular member 18. It is understood end 54 of intermediate tubular member 50 can be similarly formed.

Further, the method includes providing a male forming tool 40 having a male forming end 42 having an opening 44 with an entry inner diameter (z−Δe') larger than the outer diameter (x) of the tubular members 12, 50, and 18 and an inwardly disposed inner diameter (z−Δd') which is slightly smaller than diameter (z−Δd) of the female forming tool 30. When the male forming end 42 receives under pressure end 16 of the tubular member 12 it permanently deforms end 16 to have outer diameter deformed complementary to be friction fit received into the female end 22 of tubular member 18. It is understood end 52 of intermediate tubular member 50 can be similarly formed.

The formed male end 16 and female end 22 are of a minimal tolerance to cause the same to become substantially permanently connected when press fit to each other. The method further includes providing cleaning head 26, such as a mop or broom, providing cleaning head connector 24 and connecting the same to end 14, for example, to form a cleaning implement.

By so providing, the instant invention, there is an advantage in that the tubular members 12, 50 and 18 enable the connection to become substantially permanent press-fit where they are put together only once. The interconnectable tubular members 12 and 18 members enable the shipment in a smaller box. The very popular Swiffer™ is an example of existing cleaning implement wherein the instant invention can provide an improved multi-piece handle that is easy to put together but nearly impossible to take apart all while being easily shipped.

Figure 5:
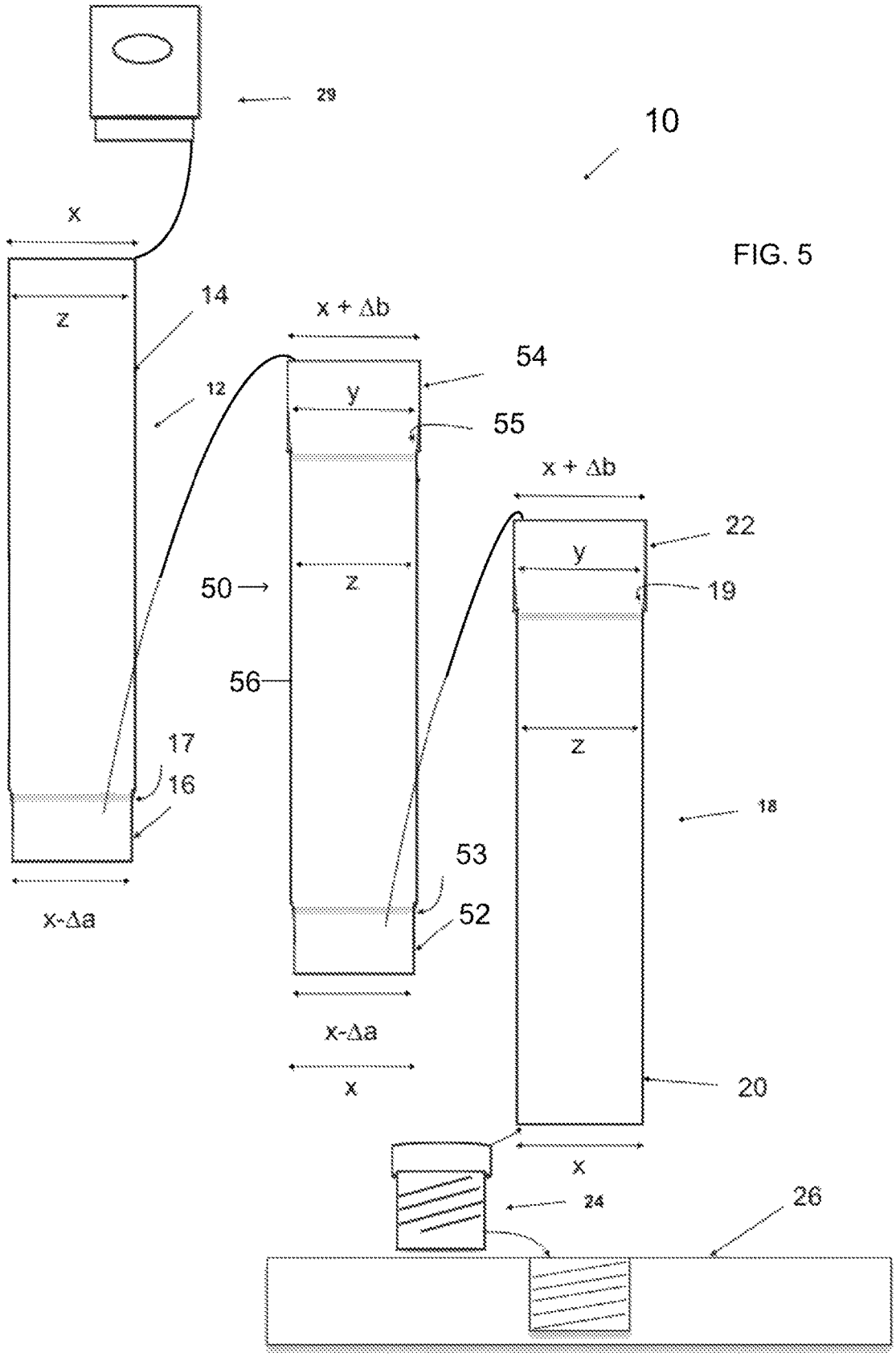
FIG. 5 depicts another embodiment of the invention.

It is contemplated that there can be more than two tubular members, such as three, four or five members, in which case interconnecting set of ends can be similarly formed to that described above and as such the middle tubular member would have both ends modified to have any combination of male/female ends. FIG. 5 depicts intermediate tubular member 50 having a similarly formed smaller end 52 and enlarged end 54. The end 52 connects to an intermediate section 56 by way of a tapered section 53 and The end 54 connects to an intermediate section 56 by way of a tapered section 55. Thus, if a 60 inch handle is desired, it could be made of four 15 inch, three 20 inch or two 30 inch pieces to make a 60 inch which is the standard length for may cleaning tools. So, a 24 inch push broom could come with three 20 inch pieces in a compact 24 inch shipping box.

A use of the invention can be for lobby dust pans, where all handles are currently desirably 30 inch and prior hereto required a 30 inch long box. The dust pan may be only 15 inch and with the instant invention two pieces about 15 inch long can be employed so that the lobby dust pan and handle would fit nicely into a box which is about 15 inch long saving both box cost and shipping costs and storage space costs.

Other modifications, derivations and improvements will be readily apparent to those skilled in the art. Accordingly, the appended claims hereto should be afforded the coverage of such modifications, derivations and improvements.

What is claimed is:

1. A multi-component quick assembly handle, which includes:

a first tubular member (12) made of a permanently deformable material formed with a predetermined diameter (x) and an inner diameter (z) and having a first end (14) and connecting to a second end (16) of a smaller diameter (x−Δa);

an intermediate tubular member (50) made of a permanently deformable material formed with a predetermined diameter (x) and inner diameter (z) having a first end (52) of a smaller diameter (x−Δa) and connecting an intermediate section (56) which in turn connects to a second end (54) having a larger diameter (x+Δb) and an inner diameter (y) slightly larger than diameter (x−Δa) to complementary receive by way of a friction fit said second end (16) of said first tubular member (12); and a second tubular member (18) made of a permanently deformable material formed with a predetermined diameter (x) and and an inner diameter (z) and having a first end (20) with a predetermined diameter (x) and connecting a second end (22) having a larger diameter (x+Δb) and an inner diameter (y) slightly larger than diameter (x−Δa) to complementary receive by way of a friction fit said first end (52) of said intermediate tubular member (50), wherein at least one of said first ends (14, 20) has a connector (24).

2. The multi-component quick assembly handle of claim 1, wherein said first end (14) of said first tubular member (12) connects to said second end (16) of said first tubular member (12) by way of a tapered section (17), said ends (52, 54) of said intermediate tubular member 50 connect to said intermediate section (56) by way of a tapered sections (53, 55) and said first end (20) of said second tubular member (18) connects to said second end (22) of said second tubular member (18) by way of a tapered section (19).

3. The multi-component quick assembly handle of claim 1, wherein at least one of said first ends (14, 20) has a threaded connector (24) for connecting a cleaning head (26).

4. The multi-component quick assembly handle of claim 3, which includes a cleaning head (26) to form a cleaning implement.

5. The multi-component quick assembly handle of claim 1, wherein said tubular members are made from an extrudable metal material.

6. The multi-component quick assembly handle of claim 1, wherein at least one of said first ends (14, 20) has an end plug (29) with an eyelet connected thereto.

7. A method of forming multi-component quick assembly handle (10), which includes the steps of: providing a first tubular member (12) and a second tubular member (18) of a first predetermined inner diameter (z) and a second predetermined outer diameter (x) wherein said tubular members (12, 18) are made of a permanently deformable material; providing a female forming tool (30) having a female forming end (32) including a terminal portion (34) of a diameter (z−Δd) smaller than said first inner diameter (z) and a section 36 having a maximum outer diameter (z+Δe) slightly larger than said first inner diameter (z) which connects to a remaining portion (38) of said female forming tool (30) and wherein said female forming end 32 is inserted into end (22) of said second tubular member (18) under pressure to permanently deform into female end (16) of the first tubular member (12); providing a male forming tool (40) having a male forming end (42) having an opening (44) with an entry inner diameter (x+Δe') larger than the second outer diameter (x) of the tubular members (12, 18) and an inwardly disposed inner diameter (z−Δd') which is slightly smaller than diameter (z−Δd) of the female forming tool (30), wherein said male forming end (42) receives under pressure end (16) of said tubular member 12 to permanently deform end (16) to have outer diameter deformed complementary to be friction fit received into said female end (22) of tubular member (18).

8. The method of claim 7, further includes providing a cleaning head connector (24) and connecting said connector (24) to one of said ends (14, 20).

9. The method of claim 8, further includes providing cleaning head (26) and connecting said cleaning head (26) to said connector 24 to form a cleaning implement.

10. The method of claim 7, further includes providing an end plug (29) with an eyelet to at least one of said first ends (14, 20).

* * * * *